US005821679A

United States Patent [19]

Makishima

[11] Patent Number: 5,821,679

[45] Date of Patent: Oct. 13, 1998

[54] ELECTRON DEVICE EMPLOYING FIELD-EMISSION CATHODE

[75] Inventor: Hideo Makishima, Tokyo, Japan

[73] Assignee: NEC Corporation, Tokyo, Japan

[21] Appl. No.: 634,706

[22] Filed: Apr. 18, 1996

[30] Foreign Application Priority Data

Apr. 20, 1995 [JP] Japan ..... 7-117707

[51] Int. Cl.[6] ..... H01J 1/30

[52] U.S. Cl. ..... 313/310; 313/495

[58] Field of Search ..... 313/309, 310, 313/336, 351, 496, 495

[56] References Cited

U.S. PATENT DOCUMENTS

| | | | |
|---|---|---|---|
| 5,258,685 | 11/1993 | Jaskie et al. | 313/336 X |
| 5,289,086 | 2/1994 | Kane . | |
| 5,391,956 | 2/1995 | Watanabe et al. | 313/309 |
| 5,561,340 | 10/1996 | Jin et al. | 313/309 |
| 5,578,901 | 11/1996 | Blanchet-Fincher et al. | 313/310 X |
| 5,619,093 | 4/1997 | Glesener et al. | 313/309 |
| 5,623,180 | 4/1997 | Jin et al. | 313/310 |
| 5,637,950 | 6/1997 | Jin et al. | 313/310 |

FOREIGN PATENT DOCUMENTS 6-208835 7/1994 Japan .

OTHER PUBLICATIONS

C.A. Spindt, "A Thin–Film Field–Emission Cathode", *Journal of Applied Physics*, vol. 39, No. 7, Jun. 1968, pp. 3504–3505.

R. Meyer, "Recent Development On 'Microtips' Display At LETI", *Technical Digest of IVMC 91*, Nagahama, 1991, pp. 6–9.

N. Kumar et al., "Development of Nano–Crystalline Diamond–Based Field–Emission Displays", *SID 94 Digest*, pp. 43–46.

*Primary Examiner*—Hezron E. Williams
*Assistant Examiner*—Daniel S. Larkin
*Attorney, Agent, or Firm*—Young & Thompson

[57] ABSTRACT

Concave portions are formed, in a matrix fashion, in a substrate formed of metal or semiconductor. An electron emission layer made of material having small work function such as a diamond thin film is formed on the bottom portion of the concave portion. A protruding portion of the substrate serves as a beam formation electrode. Divergence of electrons can be suppressed with the beam formation electrode. A gate electrode for drawing out the electrons is formed above the beam formation electrode.

16 Claims, 5 Drawing Sheets

ELECTRON DEVICE EMPLOYING FIELD-EMISSION CATHODE

BACKGROUND OF THE INVENTION

1. Field of the Invention

The present invention relates generally to electron devices using field-emission cathode and more particularly to electron devices using diamond based field-emission cathode.

2. Description of the Prior Art

C. A. Spindt proposes a field-emission cathode in Journal of Applied Physics, Vol. 39, No.7, p.3504, 1968. The field-emission cathode comprises an array of micro cold cathodes, each of which is composed of a cone-shaped emitter and a gate electrode. The gate electrode draws out the current from the emitter and controls the current.

Such field emitter array (FEA) has advantages that the FEA is capable of obtaining a high current density compared to a hot cathode and velocity dispersion of emitted electrons is little. Furthermore, the FEA produces less current noises compared to a single field-emission cathode, and operates at a voltage as low as several 10 to 200 V.

A flat display device was manufactured by way of trial and was made public (IVMC'91 Technical Digest, p.6, 1991) in which these FEAs are arranged in rows and columns as an electron source and electrons are radiated onto fluorescent substances opposed thereto whereby the fluorescent substances emit light.

FIG. 7 is a sectional view showing a structure of this flat display device. As shown in FIG. 7, a conductive layer 102 is formed on a rear glass plate 101. A cone-shaped protrusion electrode (emitter) 103 is formed on the conductive layer 102. An insulating film 104 and a gate electrode 105 are formed on the conductive layer 102, successively. A transparent conductive film 107 serving as an anode is formed on a front glass plate 106 disposed apart from a predetermined distance from the field-emission cathode. A fluorescent substance layer 108 is formed on the transparent conductive film 107.

When such a field emission display (FED) is compared to a liquid crystal display having a back-light source, the FED consumes less power and performs a spontaneous light emission so that it displays with a wide visual angle. However, the tip portion of the protrusion electrode 103 must be made acute. Furthermore, since the height and shape of the protrusion electrode greatly affect the electron emission efficiency, high processing precision is required.

To this end, field emission electron devices employing diamond based field emission cathode are proposed in U.S. Pat. No. 5,289,086 and Japanese Unexamined Patent Publication (Kokai) No. 6-208835 (corresponding to U.S. patent application Ser. No. 938,744), respectively.

FIG. 8 is a sectional view of the display device disclosed in the latter, in which a stripe-shaped conductive layer 202 is formed on a substrate 201 and a fluorescent substance layer (a cathode luminescence layer) 203 is formed on the stripe-shaped conductive layer 202.

A transparent conductive layer 205 perpendicular to the conductive layer 202 is formed on a face plate 204 and a diamond material 206 is formed on the conductive layer 205. In FIG. 8, though only one conductive layer 202 and one transparent conductive layer 205 are illustrated, a plurality of conductive layers are actually formed. The portion where the conductive layer 202 and the transparent conductive layer 205 cross each other constitutes one pixel. When a voltage is applied between both conductive layers, electrons are emitted from the diamond material layer 206 and the electrons emitted from the layer 206 attack the fluorescent substance layer 203 whereby the fluorescent substance layer 203 emits light. The display light thus obtained is irradiated into the outside via the face plate 204.

The diamond material layer 206 is formed of one of a single crystal diamond layer, a polycrystalline diamond material layer, and granular discrete diamond crystals.

The work function of a diamond crystal is small compared to those of ordinary metals or silicon so that the electrons are emitted with a very low electric field. Specifically, an electron emission electric field of metals and semiconductors is about $3\times10^7$ V/cm, and an electron emission electric field of diamonds is as low as $5\times10^5$ V/cm, which is lower by two orders of magnitude. For this reason, the electron device using the diamond thin film is not required to have the acute structure to concentrate the electric field, and is not required to be formed with a high processing precision, unlike the prior art FEA shown in FIG. 7.

In this prior art, lithography technology is not necessary for the formation of the micro structure whereby a high resolution exposing apparatus is not demanded. The manufacturing steps are simplified and, moreover, the structure of the device becomes simple.

However, in this display device, the electrons are drawn directly out from the cathode (transparent conductive layer 205) by the anode (conductive layer 202). Therefore, the application of a high voltage between both electrodes is necessary. According to this prior art, the distance between the substrate 201 and the face plate 204 is set to be less than 1 $\mu$m, whereby the device can be operated with a voltage less than 10 V. In actual display devices, it is difficult to dispose a substrate and a face plate, both having a large area, at such a small distance and maintain reliability. The distance between the anode and the cathode must be 10 $\mu$m to 100 $\mu$m. For this reason, in order to produce the electric field at the surface of the cathode required to emit the electrons, the voltage between the anode and the cathode should be 300 V to 500 V.

Even when a signal voltage at a linear region of the voltage-current characteristic is applied utilizing the non-linearity of the voltage-current characteristic, an applied signal voltage of ±80 to ±150 volts is necessary. The flat display device requires driving circuits corresponding to the number of pixels in horizontal and vertical directions. Therefore, when the applied signal voltage is high, a load of external driving circuits is extremely large.

Furthermore, when the voltage between the anode and the cathode is varied, an accelerating voltage for attacking the fluorescent substance as well as an emission current also vary. Therefore, it becomes difficult to perform a fine adjustment for the display screen, particularly for a color display screen.

In addition, since the micro structure of the diamond thin film is not necessarily uniform, the direction of the partial emitted electrons is not perpendicular to the face plate 204 and the substrate 201 and the velocity component in a longitudinal direction. For this reason, there is a possibility that electrons irradiate the adjacent pixel so that a resolution and a contrast of the display screen are deteriorated. Particularly, colorimetric purity is reduced in the color flat display device.

When, for example, a voltage between the anode and the cathode is 200 V and a distance between the anode and the cathode is 50 $\mu$m, electrons emitted at an angle of 30 degree from a central axis irradiate the position at a distance of about 15 $\mu$m on a screen where an anode is formed.

To prevent this influence, it is necessary to form a barrier so that an electron does not reach an adjacent pixel. For example, to realize such a barrier, the area of a fluorescent substance is made wider compared to the area of a cathode of one pixel, and the distance between a cathode and an anode (fluorescent substance) is made smaller so that an electron beam attacks the fluorescent substance before the electron beam diverges. For this reason, the problems caused are that the precision of the display device is limited and the structure of the display device is complicated.

Another prior art display device using the diamond thin film as an electron emission layer has been proposed in SID 94 DIGEST, p. 43, 1994 by N. Kumar et al. The structure of this display device is shown in FIG. 9. As shown in FIG. 9, a metal strip 302 is formed on a rear glass plate 301, and a diamond material layer 303 is formed on the metal strip 302. Above the diamond material layer 303, a grid 304 supported by a grid supporting member 305 is disposed. A transparent conductive layer 307 and a fluorescent substance layer 308 are formed on a front glass plate 306 which is supported by a spacer 309.

In the prior art device shown in FIG. 9, since the grid 304 has an opening of about 1 $\mu$m to several $\mu$m and must be supported between the front glass plate 306 and the electron source (the diamond material layer 303), the structure of the display device is complicated. Furthermore, it is necessary to manufacture the grid 304 having the micro structure. It is very difficult to adjust the mutual positions of the grid and the electron source with a high precision. Furthermore, like the second prior art device shown in FIG. 8, there is the problem of the electron beam diversion.

SUMMARY OF THE INVENTION

Therefore, an object of the present invention is to provide a flat display device which does not require a high precision processing and is manufactured easily.

Another object of the present invention is to provide a flat display device which is driven with a low current modulation voltage.

Still another object of the present invention is to provide a flat display device which can obtain a high resolution, contrast, and calorimetric purity.

To achieve the above objects, according to the present invention, a beam formation electrode is provided above a diamond thin film. The diamond thin film as an electron emission layer is formed on the bottom surface of concave portions formed in a substrate. The beam formation electrode is disposed so as to surround the electron emission layer. Furthermore, a gate electrode for drawing out electrons from the diamond thin film is provided on the beam formation electrode via an insulating layer.

Moreover, according to the present invention, there is provided a display device in which a front glass plate and a rear plate are disposed at a predetermined distance. The front glass plate, comprising a transparent conductive film serving as an anode and a fluorescent substance layer formed on the transparent conductive film, and the rear plate, comprising the field-emission cold cathode of the above constitution, are disposed at a predetermined distance.

In the field-emission cold cathode constituted as above, the formation of an emitter having an acute tip is not required so that the field-emission cathode can be manufactured without the use of a high precision lithography apparatus. A beam formation electrode is disposed near an electron source whereby the beam shape is made narrow. The overlap of the beam is prevented so that an increase in resolution can be achieved. Furthermore, the gate electrode to draw out the electrons is formed. It follows that the field-emission cathode of the present invention can be driven with a low current modulation voltage.

By installing this electron source in a flat display device, the flat display device, in which the structure is simplified, the area is made larger, and the voltage is low by virtue of the modulation of the current, can be achieved. Furthermore, the amount of the electrons attacking the fluorescent substances of the adjacent pixel is reduced whereby the resolution, the contrast, and the calorimetric purity can be improved.

Furthermore, since the current value and the acceleration voltage can be established independently, the optimum adjustment of the luminance and the hue of the screen can be performed.

Since the divergence of the electron beam is small and the necessity drawing out of the current with the anode is not present, the distance between the cathode and the anode can be set to the necessary and sufficient condition value. Thus, the vacuum exhaustion resistance can be suppressed to a small value. Furthermore, since the seriousness of the problem concerning insulation between the anode and the cathode can be reduced, an anode voltage is set high, and a high light emission luminance and a high luminous efficiency can be realized.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Figure 1:
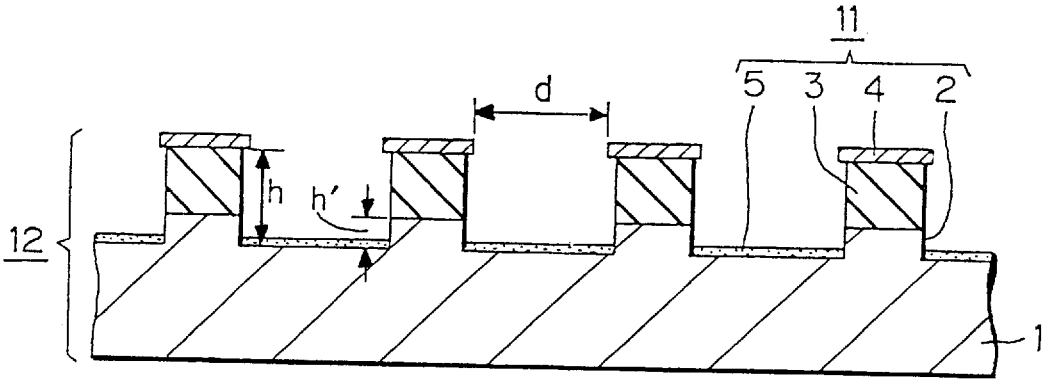
FIG. 1 is a sectional view of a field-emission cathode of the first embodiment according to the present invention.
Figure 2:
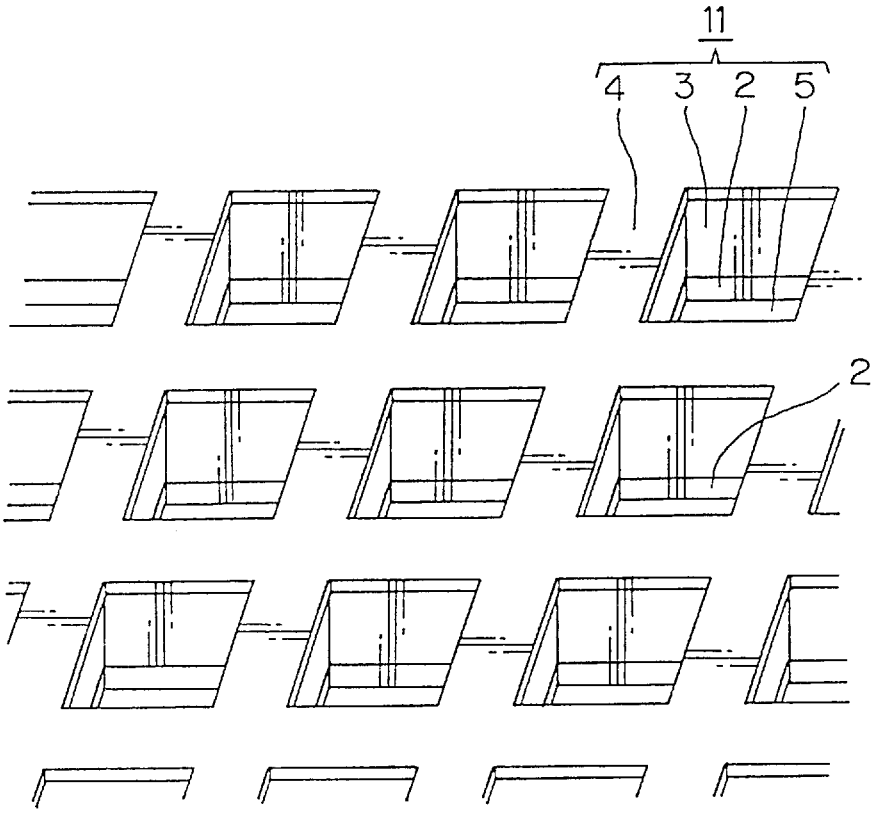
FIG. 2 is a perspective view of the field-emission cathode of the first embodiment according to the present invention.

Referring to FIGS. 1 and 2, a plurality of rectangular-shaped concave portions are formed, in a matrix fashion, in a substrate 1 made of either a metal or a semiconductor. The concave portions of the substrate 1 constitute a plurality of beam formation electrodes 2. An insulating layer 3 is formed on each of the beam formation electrodes 2. A gate electrode 4 which is either a thin film or a thick film made of a metal material is formed on the insulating layer 3. An electron emission layer 5 is formed on each bottom surface of the concave portions of the substrate 1. The electron emission layer 5 is made of a material having a small work function less than those of metal and semiconductor. The electron emission layer 5, the beam formation electrode 2 surrounding the electron emission layer 5, the insulating layer 3, and the gate electrode 4 constitute a micro cold cathode 11. Moreover, the micro cold cathode 11 and the substrate 1 constitute a cathode 12.

In this embodiment, a plurality of the micro cold cathodes 11 are formed on the substrate 1. However, a single micro cold cathode may be used for a special cases.

The dimensions of each portion of the device are determined according to the purpose. The dimension d of an opening of the gate electrode 4 is about 5 $\mu$m to several tens of $\mu$m. The distance h from the bottom of the concave portion to the gate electrode 4 should be set longer than one-half of the dimension d of the opening of the gate electrode 4. Furthermore, in order to converge the electron beam emitted from the electron emission layer 5 effectively, it is necessary to position the beam formation electrode 2 at a higher level h' than the electron emission layer 5.

A semiconductor or a metal, for example, is used for the substrate 1, and a silicon oxide or a silicon nitride is used for the insulating layer 3. Though a semiconductor wiring material may be used for the gate electrode 4, a heat resistant material such as tungsten, molybdenum, or niobium and their compounds are preferable materials.

The electron emission layer 5 is a material including a substance of a small work function such as a diamond material which shows a very low work function compared with metal and semiconductor materials. The electron emission layer 5 should preferably be formed of a single crystal diamond, a polycrystalline diamond, or a non-crystalline diamond. The electron emission layer 5 may also be also preferably formed of a material including two or more of these components. Here, the non-crystalline diamond indicates a thin film formed by a Laser Ablasion technique for carbon. Specifically, it indicates a film in an amorphous diamond state, one composed of extremely fine diamond crystals, or one in which amorphous diamond and extremely fine diamond crystals are mixed. The polycrystalline diamond thin film can be formed on the silicon substrate by a microwave plasma CVD technique using CO gas as a main material or a thermal filament CVD technique. The formation of the single crystal diamond thin film is not so easy as that of the polycrystalline diamond thin film. The single crystal diamond thin film can be also formed by the CVD technique.

Figure 3:
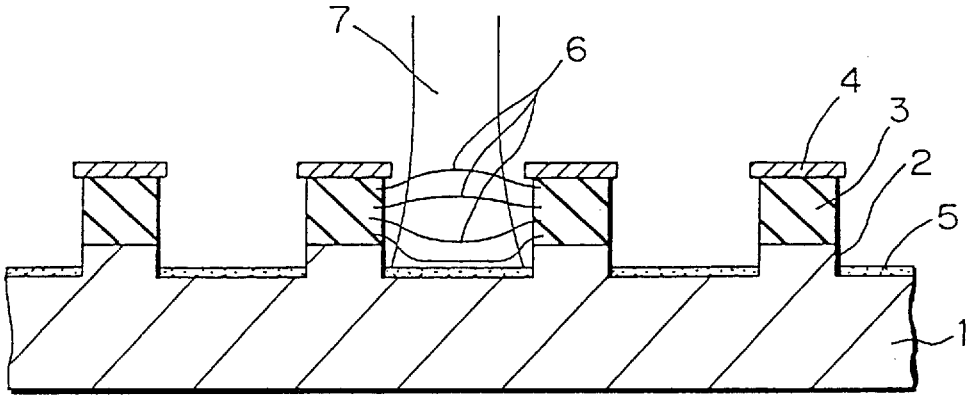
FIG. 3 is a sectional view for explaining the advantageous effect of the field-emission cathode of the first embodiment according to the present invention.

In order to operate the cathode 12, the gate electrode 4 is applied with a current modulation voltage of about 10 V to several tens of volts compared to the potential at the substrate 1 and the electron emission layer 5. Electrons are emitted from the electron emission layer 5 by the voltage applied to the gate electrode 4. In FIG. 3, the equipotential lines 6 and the orbits of the electron beam 7 in the above situation are illustrated. The equipotential lines 6, which serve to concentrate the emitted electrons at the center portion, are formed at the periphery of the electron emission layer 5 by the beam formation electrode 2 whereby the electron beam orbits are converged. Thus, all of the emitted electrons do not strike the gate electrode 4 and the insulating layer 3 and pass through the opening of the gate electrode 4.

Figure 4:
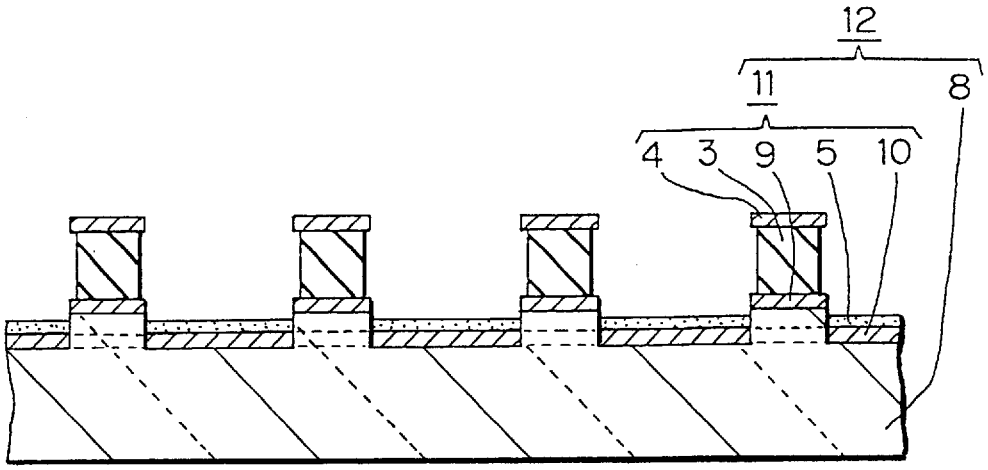
FIG. 4 is sectional view of a field-emission cathode of the second embodiment according to the present invention.

In the second embodiment shown in FIG. 4, a substrate is formed of an insulating substance unlike the first embodiment shown in FIG. 1. As shown in FIG. 4, a plurality of rectangular-shaped concave portions are formed, in a matrix fashion, in an insulating substrate 8. A beam formation electrode 9 is provided on the convex portion of the substrate 8 where the concave portion is not formed. An insulating layer 3 is formed on the beam formation electrode 9.

A gate electrode 4 which is either a thin film or a thick film made of a metal material is formed on the insulating layer 3. A cathode electrode layer 10 is formed on the concave portion of the insulating substrate 8. An electron emission layer 5 is formed on each cathode electrode layer 10. The electron emission layer 5 is made of a material having a small work function. The electron emission layer 5, the beam formation electrode 9 surrounding the electron emission layer 5, the insulating layer 3, and the gate electrode 4 constitute a micro cold cathode 11. Moreover, the micro cold cathode 11 and the insulating substrate 8 constitute a cathode 12.

It should be noted that the cathode electrode layer 10 is connected to the adjacent cathode electrode layer through a groove portion formed in a region (not shown) of the insulating substrate 8.

Since the beam formation electrode 9 may be applied with a voltage different from that applied with the electron emission layer 5 and the cathode electrode layer 10, the rate of the electrons passing through the gate electrode 4 to the electrons emitted from the electron emission layer 5 can be set so as to be greatest. Furthermore, this is available for optimizing the electron beam spot shape in a collector or a screen against the cathode 12 (not shown).

Figure 5:
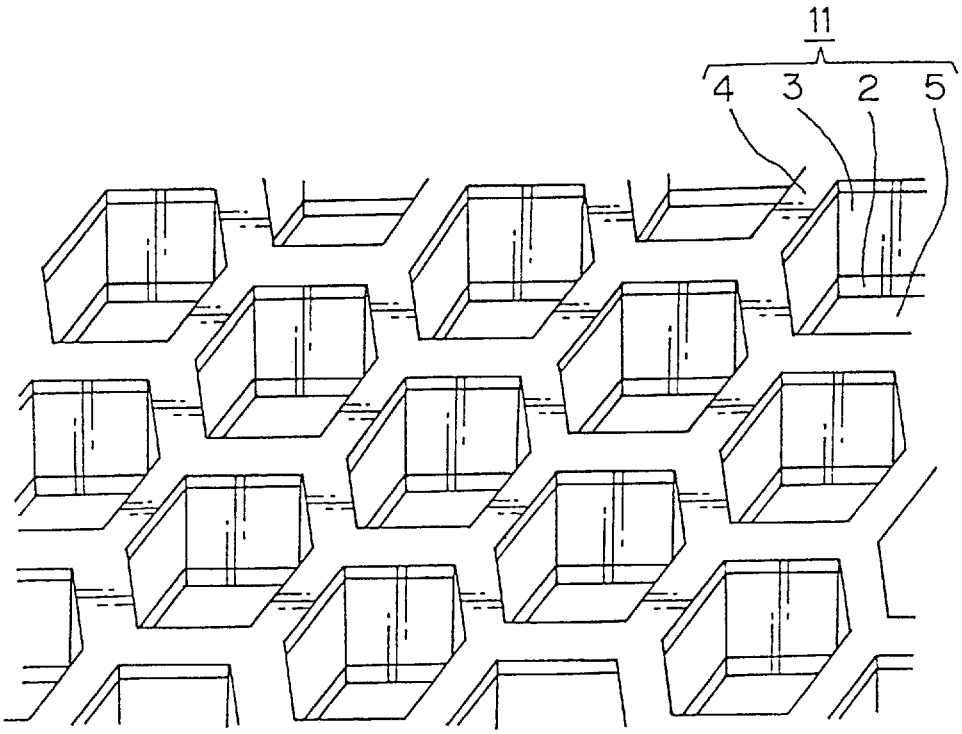
FIG. 5 is a perspective view of a field-emission cathode of the third embodiment according to the present invention.

Referring now to FIG. 5, since like reference characters designate like or corresponding parts of the first embodiments shown in FIGS. 1 and 2, the explanations for the like or corresponding parts will be omitted. In this embodiment, the shapes of an opening in the gate electrode 4 and of the electron emission layer 5 are hexagonal not rectangular. The opening and the electron emission layer 5 are arranged in a zigzag fashion.

The electron emission layer 5 can control the electron emission when the shape of the layer 5 is other than rectangular and hexagonal. When the shape of the electron emission layer 5 is, for example, circular, the field effect intensity distribution at the emission axis direction on the surface of the electron emission layer 5 is most uniform. However, it follows that the effective area coefficient, i.e. the electron emission area for the whole area of the cathode is smaller.

On the other hand, when the shape of the electron emission layer 5 is hexagonal, the field intensity distribution at the emission axis direction on the surface of the electron emission layer 5 is more uniform than in the rectangular pattern whereby the current controllability of the gate electrode 4 is improved. Thus, the current control can be performed with a lower voltage. Furthermore, when the shape of the electron emission layer 5 is a regular hexagon, since the regular hexagons can fill the plane better than rectangles, the effective coefficient of utilization on the plane, i.e., the effective area coefficient is better than the rectangular pattern. Thus, more cathode current can be taken out.

In the third embodiment of FIG. 5, the substrate may be formed of a metal or a semiconductor like the first embodiment of FIG. 1 However, the substrate may be formed of an insulating material like the second embodiment of FIG. 4. In those cases, the cathode utilizing the merits of the second and third embodiments can be realized.

Furthermore, in this embodiment the plurality of the micro cold cathodes 11 are formed on the substrate. It should be noted that the cathode may be constituted by a single micro cold cathode.

Figure 6:
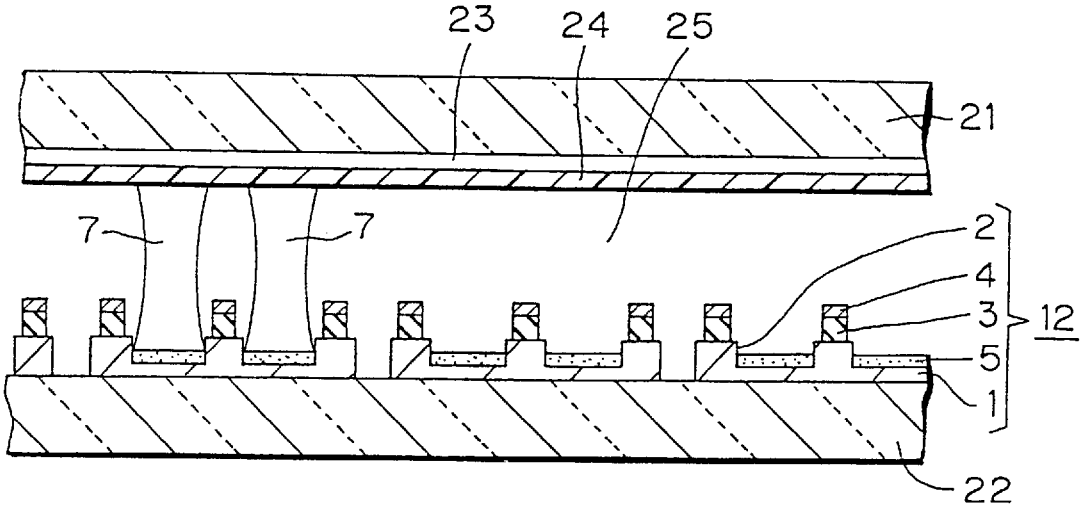
FIG. 6 is a sectional view of a flat display device of the fourth embodiment according to the present invention.
Figure 7:
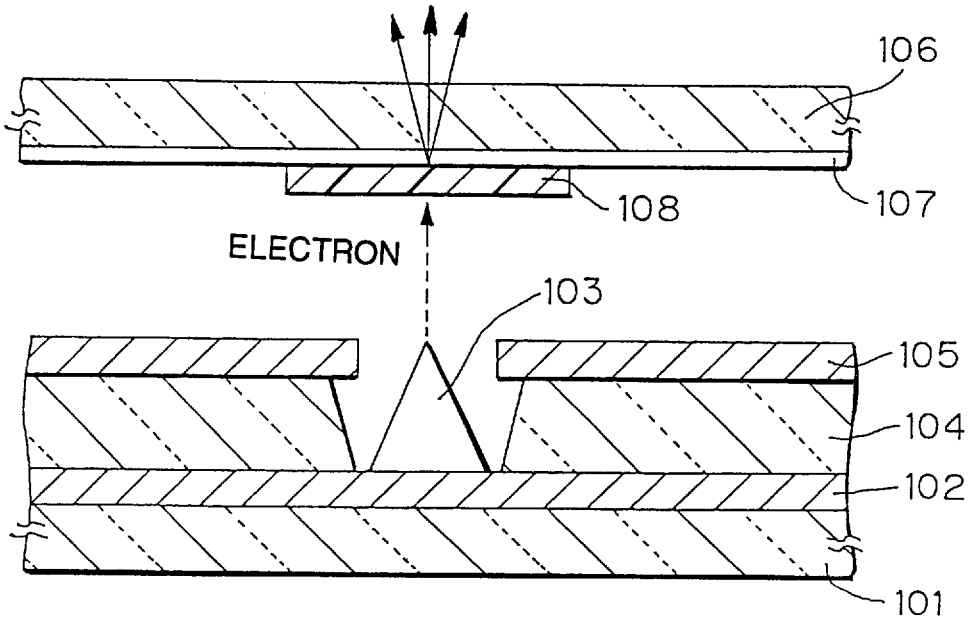
FIG. 7 PRIOR ART
FIG. 7 is a sectional view of a flat display device of a prior art device.
Figure 8:
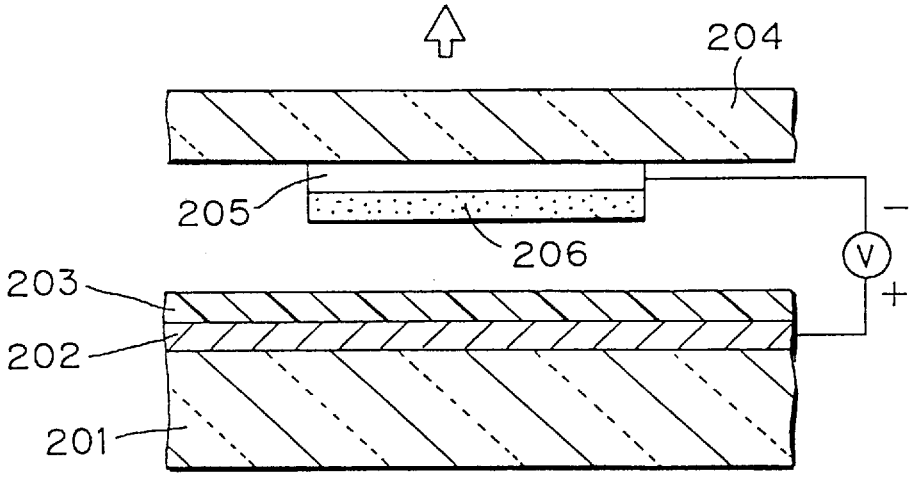
FIG. 8 PRIOR ART
FIG. 8 is a sectional view of a flat display device of a further prior art device.
Figure 9:
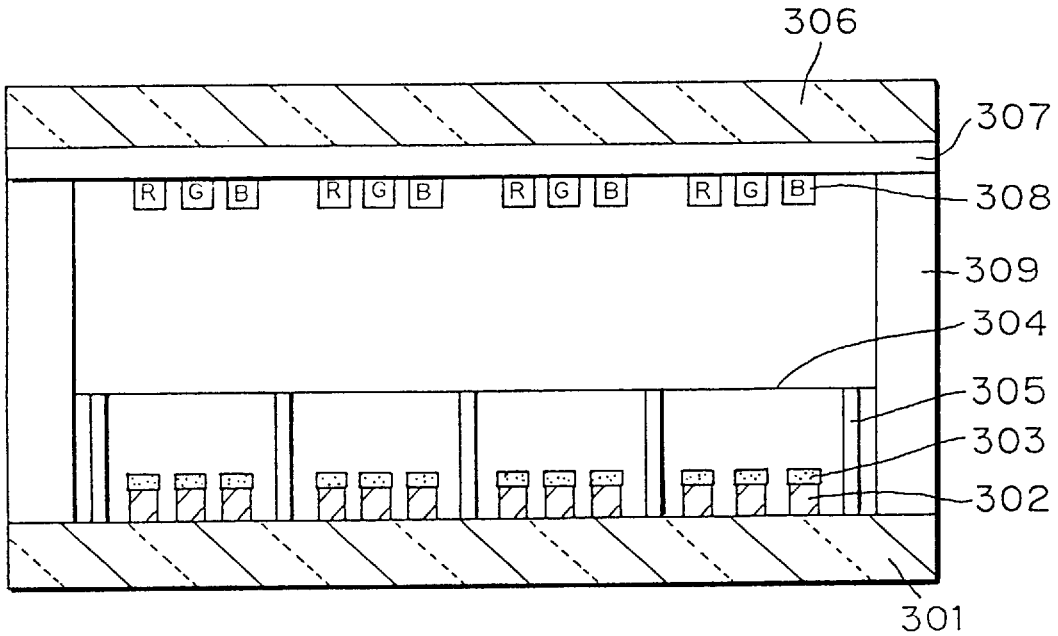
FIG. 9 PRIOR ART
FIG. 9 is a sectional view of a flat display device of another prior art device.

Referring now to FIG. 6, in fourth embodiment a front side glass plate 21 constitutes a part of a vacuum external housing, and an anode 23 formed of a transparent conductive film (ITO film) is formed on an inner surface under vacuum. A fluorescent substance layer 24 is formed on the anode 23. Furthermore, a rear glass plate 22 constitutes a part of the vacuum external housing, and the rear glass plate 22 and the front glass plate 21 face interposing a narrow vacuum space 25 of about several tens to several hundreds of $\mu$m.

A cathode 12 is formed on the surface of the rear glass plate 22 facing the vacuum space 25. A plurality of substrates 1 of the cathode 12 are formed on the rear glass plate 22 and a plurality of gate electrodes 4 of the cathode 12 are formed on the substrates 1. The substrate 1 and the gate electrodes 4 are striped and intersect at right angles. The stripe of the substrate 1 and the stripe of the gate electrode 4 constitute scanning electrodes in columns and rows. The cross portion of them is an electron source of one pixel. In FIG. 6, an example in which one pixel is constituted of 2×2 micro cold cathodes 11, i.e., four micro cold cathodes, is shown. Each pixel may include one or more micro cold cathodes 11.

In order to operate the flat display device shown in FIG. 6, a voltage of several volts to several tens of volts is applied between the gate electrode 4 and the substrate 1 so that the gate electrode 4 is rendered positive, and a voltage of 100 volts to several hundreds of volts against the substrate 1 of the cathode 12 is applied to the anode 23. As a result, electrons are emitted from the micro cold cathode 11 of the selected pixel, and the electrons allow the fluorescent substance layer 24 to emit light by striking against the layer 24.

In the flat display device of this embodiment, since an electric field produced by the beam formation electrode 2 of the cathode 12 converges the electron beams, the number of electrons striking the fluorescent substance of the adjacent pixel is reduced. Thus, resolution, contrast, and calorimetric purity are improved.

Furthermore, since the current value and the acceleration voltage can be established independently, the optimum adjustment of the luminance and hue of the screen can be performed. Since the divergence of the electron beam is small and the necessity of drawing out the current with the anode is not present, it is not necessary to reduce the distance between the cathode and the anode narrow, and the distance between the cathode and the anode can be set to the necessary and sufficient condition value. Thus, the vacuum exhaustion resistance can be suppressed to a small value. If the distance between the cathode and the anode can be set large, the seriousness of the problem concerning the insulation between the cathode and the anode can be relaxed. The anode voltage can be set high, and a high light emission luminance and a high luminous efficiency can be realized.

In order to afford the function of a color picture display to the flat display device of this embodiment, the flat display device can be equipped with the function of the color picture display in a manner similar to the conventional flat display device which uses FEA as an electron source (for example, IVMIC' 91 Technical Digest, p.6, 1991). The fluorescent substance 24 is divided and fluorescent materials having the different properties are used for each of the fluorescent substances. At the same time, the anode or the cathode is divided and both are applied with a voltage independently.

Furthermore, the flat display device of the fourth embodiment was described as one which uses the field-emission cathode of the first embodiment. The device of the fourth embodiment may use the field-emission cathode of the second and third embodiments. The flat display device utilizing the respective merits of the second and third embodiments can be constituted.

In the description of the fourth embodiment, the flat display device which displays the image information obtained by combining the column and row scannings was described. The gate electrode 4 or the cathode electrode 10 may be formed in the shape of characters, numerals, or figures. Then, a fluorescent display device in which the fluorescent substance is allowed to emit light according to these shapes may be adopted.

As described above, according to the present invention, the electron source in which a current modulation voltage is low and the divergence of the emitted electrons is suppressed can be manufactured easily without using a high precision lithography apparatus.

By introducing this electron source into the flat display device, the flat display device having a simplified structure and a large screen area can be realized, in which a current modulation voltage is low. Furthermore, the amount of the electrons striking the adjacent fluorescent substance of pixels is reduced so that resolution, contrast, and calorimetric purity can be improved.

Furthermore, since the current value and the acceleration voltage can be established independently, the optimum adjustment of the luminance and the hue of the screen can be performed.

Since the divergence of the electron beam is small and the necessity drawing out of the current with the anode is not present, the distance between the cathode and the anode can be set to the necessary and sufficient condition value. Thus, the vacuum exhaustion resistance can be suppressed to a small value. Furthermore, since an anode voltage is set high, a high light emission luminance and a high luminous efficiency can be realized.

What is claimed is:

1. An electron device comprising:

a substrate having a plurality of concave portions in a matrix form on a principal surface thereof;

a flat electron emission layer formed on a bottom surface of each of said concave portions, said flat electron emission layer having a work function smaller than those of metal and semiconductor;

a beam formation electrode formed by a portion of said substrate other than said concave portion so as to entirely surround said flat electron emission layer to concentrate electrons emitted from said flat electron emission layer at a center portion of each of said concave portions;

an insulation layer formed on said beam formation electrode; and a gate electrode formed on said insulation layer.

2. An electron device according to claim 1, wherein said flat electron emission layer is made of diamond material.

3. An electron device according to claim 1, wherein said substrate is made of a metal.

4. An electron device according to claim 1, wherein said substrate is made of semiconductor.

5. An electron device according to claim 1, wherein the plane shape of said flat electron emission layer is rectangular or hexagonal.

6. An electron device according to claim 2, wherein said diamond material is a member selected from group consisting of a single crystal diamond, a polycrystalline diamond, a non-crystalline diamond and a combination thereof.

7. The device of claim 1, wherein said matrix form comprises an array of rows and columns of said concave portions.

8. The device of claim 1, wherein said insulation layer extends above said beam formation electrode a distance greater than a distance said beam formation electrode extends above said flat electron emission layer.

9. An electron device comprising:

a metal substrate having a plurality of concave portions in a matrix form on a principal surface thereof, each of said concave portions having a rectangular or hexagonal shape;

a flat electron emission layer on a bottom surface of each of said concave portions with a shape corresponding to said concave portions, said flat electron emission layer having a work function smaller than that of said substrate;

a beam formation electrode formed by a portion of said substrate other than said concave portion so as to surround said flat electron emission layer entirely;

an insulation layer on said beam formation electrode and having a plurality of apertures corresponding to said concave portions; and a gate electrode on said insulation layer and having a plurality of apertures corresponding to said concave portions.

10. The device of claim 9, wherein said matrix form comprises an array of rows and columns of said concave portions.

11. The device of claim 9, wherein the concave portions are hexagonal.

12. The device of claim 9, wherein said beam formation electrode concentrates electrons emitted from said flat electron emission layer at a center portion of each of said concave portions.

13. An electron device comprising:

a semiconductor substrate having a plurality of concave portions in a matrix form on a principal surface thereof, each of said concave portions having a rectangular or hexagonal shape;

a flat electron emission layer on a bottom surface of each of said concave portions with a shape corresponding to said concave portions, said flat electron emission layer having a work function smaller than those of metal and semiconductor;

a beam formation electrode formed by a portion of said substrate other than said concave portion so as to surround said flat electron emission layer entirely;

an insulation layer on said beam formation electrode and having a plurality of apertures with said shape of said concave portions; and a gate electrode on said insulation layer and having a plurality of apertures with said shape of said concave portions.

14. The device of claim 13, wherein said matrix form comprises an array of rows and columns of said concave portions.

15. The device of claim 13, wherein the concave portions are hexagonal.

16. The device of claim 13, wherein said beam formation electrode concentrates electrons emitted from said flat electron emission layer at a center portion of each of said concave portions.

* * * * *